US006055392A

United States Patent [19]

Huver et al.

[11] Patent Number: 6,055,392

[45] Date of Patent: Apr. 25, 2000

[54] CLEANING TONER FROM ROLLERS AND SURFACE OF BUSINESS FORMS HANDLING MACHINES

[75] Inventors: John Huver, St. Charles, Ill.; Wilbur Hutchinson, St. George, Utah

[73] Assignee: Moore U.S.A., Inc., Grand Island, N.Y.

[21] Appl. No.: 09/015,932

[22] Filed: Jan. 30, 1998

[51] Int. Cl.[7] ..... G03G 21/00

[52] U.S. Cl. ..... 399/98; 399/327; 15/256.51

[58] Field of Search ..... 399/327, 91, 98, 399/99; 15/104.001, 104.002, 208, 209.1, 210.1, 256.51

[56] References Cited

U.S. PATENT DOCUMENTS

| | | | |
|---|---|---|---|
| 3,706,491 | 12/1972 | Furman et al. . | |
| 4,046,468 | 9/1977 | Stryjewski . | |
| 4,402,599 | 9/1983 | Seto . | |
| 4,408,241 | 10/1983 | Ogawa . | |
| 4,568,174 | 2/1986 | Stange . | |
| 4,918,128 | 4/1990 | Sakai . | |
| 4,933,015 | 6/1990 | White . | |
| 5,138,390 | 8/1992 | Miyabayashi et al. . | |
| 5,142,340 | 8/1992 | Farrell et al. . | |
| 5,153,964 | 10/1992 | Gelardi et al. . | |
| 5,201,464 | 4/1993 | File . | |
| 5,227,844 | 7/1993 | Bhattacharjee et al. | 399/99 |
| 5,427,851 | 6/1995 | Mehta . | |
| 5,616,386 | 4/1997 | Okada et al. . | |

FOREIGN PATENT DOCUMENTS

| | | |
|---|---|---|
| 2-213889 | 8/1990 | Japan . |
| 3-58074 | 3/1991 | Japan . |
| 3-248187 | 11/1991 | Japan . |
| 7-114314 | 5/1995 | Japan . |

*Primary Examiner*—Joan Pendegrass
*Attorney, Agent, or Firm*—Nixon & Vanderhye P.C.

[57] ABSTRACT

A document or business forms handling machine having toner associated therewith, and also having rollers and paper guiding surfaces on which toner may collect, is simply and easily periodically cleaned using a sheet of paper having a thickness and weight comparable to 20–38 lb. bond paper (or 80–100 lb. tag stock), and having a pattern of non-tacky toner attracting and holding material (such as pressure sensitive cohesive, like a styrene-natural rubber copolymer) on at least a first face thereof covers at least about twenty percent of the first face. The cohesive engages, attracts, and holds undesirable toner as the sheet is fed through the machine, to clean it. The machine may be a photocopier, laser printer, or pressure sealer; and the pattern may be a solid block, or spaced parallel strips of cohesive.

20 Claims, 5 Drawing Sheets

11
25
29
30
26
27
28
xxxxx xxxxxxx
xxxxx xxxxxx
xxxxx xxxxxxxx
FEED THIS
DIRECTION
ONLY
xxxxx xxxxx
xxxxx xxxxx
18
24
17
22
22
13
21
14
20
22
20
20
10
15
16
12

CLEANING TONER FROM ROLLERS AND SURFACE OF BUSINESS FORMS HANDLING MACHINES

BACKGROUND AND SUMMARY OF THE INVENTION

With many pieces of equipment for handling documents or business forms, such as pressure sealing equipment sold by Moore U.S.A. under the trademark "SpeediSealer®" (e.g. models PS-1, 2, 3, 4, and 5) cleaning of toner from rollers or paper guiding surfaces of the machines can be a significant problem. Oftentimes due to safety requirements the need to meet agency approvals, the cleaning is a difficult task and often requires a service engineer. Toner tends to build up on the rollers on paper guiding surfaces and can interfere with the operation of the machine, or can streak the business forms or documents handled thereby.

Other document or other business form handling machines such as laser printers (e.g. Hewlett-Packard HP 3, 4, and 5 printers or Lexmark Optra N MICR printers), and photocopiers (e.g. Xerox 5034 and 5065 copiers) also have problems with toner build up. Cleaning is oftentimes ignored, or accomplished during infrequent visits by a service technician. Cleaning with solvents entails the use of toxic or flammable materials, and the resultant fumes can be very unpleasant. Toner build up, when it occurs, can cause image streaks on the documents or business forms being handled or produced by the machines, or can adversely affect image quality.

According to the present invention a very simple cleaning aid, and method of utilization thereof, are provided which allow for effective periodic cleaning of document or business forms handling machines—including all of the equipment described above—with a minimum of effort, and without requiring involvement by service technicians or engineers, and without unpleasant fumes, or the use of any toxic or flammable materials.

According to the present invention a method of cleaning a document or business forms handling machine (such as a pressure sealer, photocopier, or laser printer) having toner associated therewith, and also having rollers or paper guiding surfaces on which toner may collect, is provided. The method uses a sheet of paper having a pattern of non-tacky toner attracting and holding material on at least a first face thereof, and comprises the steps of: (a) When the machine is in need of cleaning, feeding the sheet of paper into the machine so that the non-tacky toner attracting and holding material comes into contact with toner on the rollers or paper guiding surfaces, removing toner from the rollers or paper guiding surfaces. And, (b) removing the sheet of paper, having removed-toner held thereon, from the machine, and ultimately discarding the sheet.

Typically step (a) is practiced by using a sheet of paper having pressure sensitive cohesive on a first face thereof, the cohesive coming into contact with the rollers of the paper guiding surfaces. The non-tacky nature of the cohesive makes it easy to handle when not actually in use, requiring no covering sheets, release sheets, or the like, yet the material is extremely effective in attracting and holding toner, being capable of cleaning most document or business forms handling machines of the type described above by one or two pass-throughs. The cohesive may be a styrene-natural rubber copolymer such as disclosed in U.S. Pat. Nos. 4,918,128, 5,427,851, and 5,201,464, and preferably is of the type sold commercially by Toppan Corporation of Japan under the trade designation TN-124.

Where the machine has both upper and lower rollers and paper guiding surfaces, step (a) may be practiced by feeding a sheet having cohesive patterns on both first and second opposite faces thereof, to attract and hold toner on both the upper and lower rollers and paper guiding surfaces. Such a sheet may be formed with the pressure sensitive cohesive on both the top and bottom faces of the sheet, or by attaching together two sheets of paper having a cohesive pattern on only a first face thereof so that the cohesive patterns face away from each other.

Where the machine comprises a manual forms advance wheel (such as a Moore model PS-3 SpeediSealer® machine), steps (a) and (b) may be practiced, at least in part, by feeding the sheet through the machine using the manual forms advance wheel. Where the machine includes one or more of an exit divert button and a jog forward button (such as a Moore model PS-4 or PS-5 SpeediSealer® machine), steps (a) and (b) may be practiced, at least in part, by operating at least one of the exit divert and jog forward buttons.

Steps (a) and (b) may be practiced using a sheet having strips of toner attracting material elongated in a first dimension and spaced from each other in a second dimension, substantially transverse to the first dimension, with step (a) practiced, at least in part, by feeding the sheet in a first direction parallel to the first dimension. Alternatively steps (a) and (b) may be practiced using a sheet having either diagonal strips of toner attracting material or a solid block of material. The cohesive material may be applied using the same type of conventional equipment which applies this same type of cohesive used in mailer type business forms that are pressure sealed using the SpeediSealer equipment, such as the forms shown in U.S. Pat. No. 5,201,464, and preferably the cohesive has a thickness of about 8.5–11 microns.

According to another aspect of the present invention a cleaner sheet is provided, for use in practicing the method as described above. Distinct from conventional mailer type business forms with pressure sensitive cohesive as the adhesive for sealing the forms, the cleaner sheet according to the invention has a very significant amount of the at least one face thereof covered by the pressure sensitive cohesive. While the percentage of the sheet covered by the cohesive may vary, in most circumstances at least 15% of one face will be covered with the cohesive, typically at least 20%, and more typically at least about 30%. Also the cleaner sheet must have sufficient integrity that it will not be adversely affected by being fed through a machine (perhaps intermittently, by operating "jog button"), and has sufficient bulk and toner holding power so that any toner removed will be held by the sheet typically without strike through. Therefore the thickness and weight that the sheet may have is a 20–36 lb. bond paper sheet (that is 20–38 lbs. per 22 inch×17 inch 500 sheet ream of paper), or an 80–100 lb. tag stock sheet (that is 80–100 lb. per 24 inch×36 inch 500 sheet ream).

Therefore according to the cleaner sheet per se aspect of the present invention, a cleaner sheet is provided comprising: A substantially quadrate sheet of paper having a thickness and weight substantially comparable to about 20–38 lb. bond paper, or 80–100 lb. tag stock, a leading edge, a trailing edge substantially parallel to the leading edge, and first and second faces. And, a pattern of non-tacky toner attracting and holding material disposed on at least the first face, spaced from at least the first edge, and covering at least about fifteen percent of the first face.

As earlier described the sheet preferably has a weight and thickness substantially the same as 100 lb. tag stock, and the material is preferably pressure sensitive cohesive, such as a styrene-natural rubber copolymer as described above. The cohesive is preferably in the configuration of substantially linear strips of cohesive elongated in a first dimension (either substantially transverse to the leading edge, or at diagonals, or in other patterns) and spaced from each other in a second dimension substantially transverse to the first dimension. The pattern is preferably spaced from the leading edge a distance of at least about two inches, preferably about three inches or more, and the cohesive typically covers at least about 15%, preferably at least about 20%, and most preferably at least about 30%, of the first face.

The sheet may have pressure sensitive cohesive on both first and second faces thereof, or the sheet may comprise a composite sheet, including first and second sheets each having a pattern of cohesive on a first face thereof, the sheets being attached together (e.g. by a pressure sensitive adhesive tape) with the patterns of cohesive facing away from each other.

According to yet another aspect of the present invention a combination of machine and sheet is provided. The combination comprises: A document or business forms handling machine (such as a photocopier, laser printer, or pressure sealer) having toner associated therewith, and also having rollers and paper guiding surfaces on which toner may collect. And, a sheet of paper having a thickness and weight substantially comparable to about 20–38 lb. bond paper, or 80–100 lb. tag stock, and having a pattern of non-tacky toner attracting and holding material (such as pressure sensitive cohesive) on at least a first face thereof and covering at least about twenty percent of the first face, the material in contact with at least one roller or paper guiding surface and removing toner therefrom.

It is the primary object of the present invention to provide a mechanism and method to effect the simple yet effective cleaning of toner from a document or business forms handling machine. This and other objects of the invention will become clear from an inspection of the detailed description of the invention and from the appended claims.

DETAILED DESCRIPTION OF THE DRAWINGS

Figure 1:
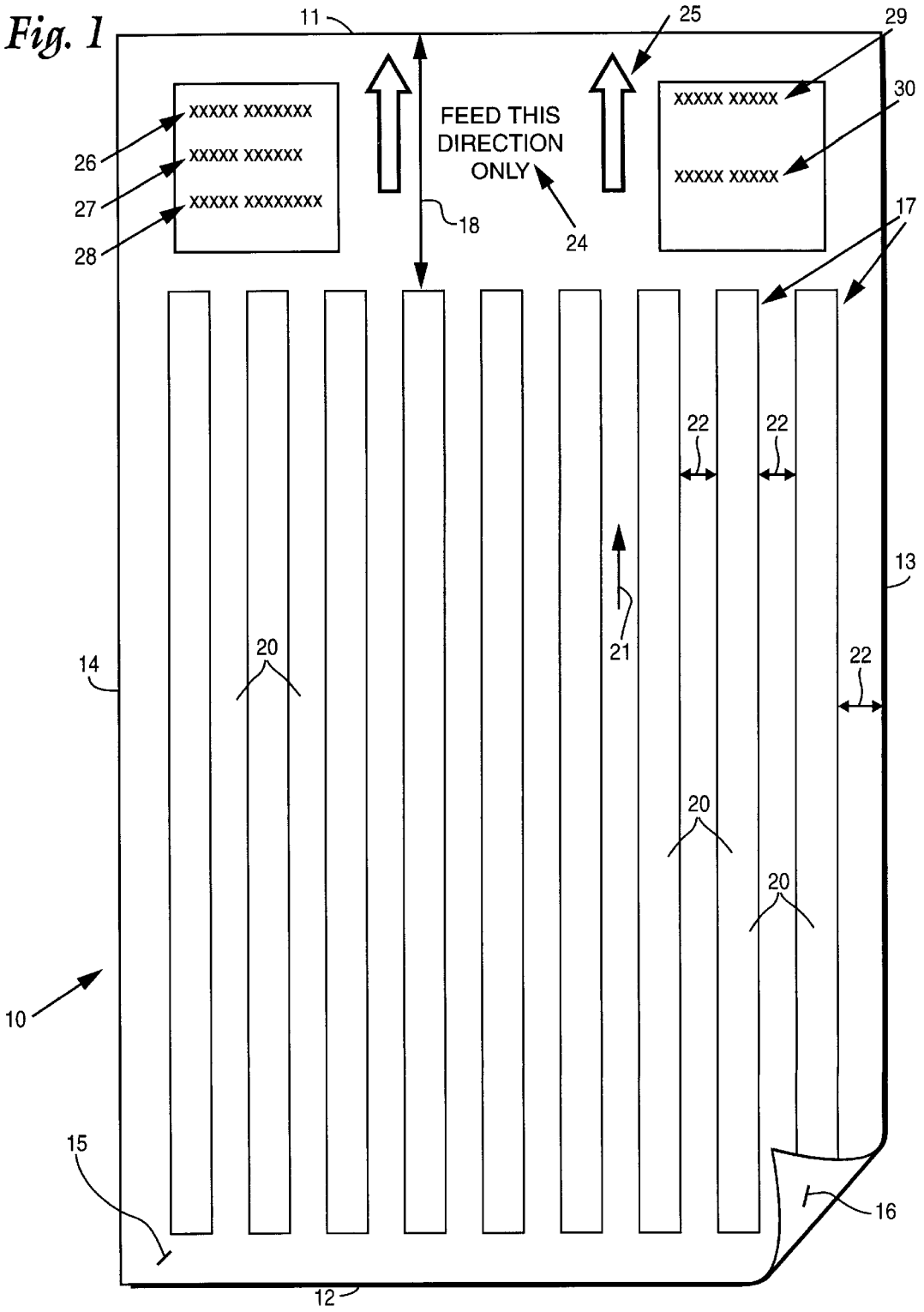
FIG. 1 is a top plan view of an exemplary cleaner sheet for a document or business forms handling equipment having toner build-up associated therewith.

A first embodiment of a cleaner sheet according to the present invention is shown generally by reference 10 in FIG. 1. The sheet 10 is a substantially quadrate sheet of paper having a thickness and weight at least as great as 20 lb. bond paer, and preferably has a thickness and weight comparable to that of 20–38 lb. bond paper, or about 80–100 lb. tag stock. The sheet 10 includes a leading edge 11, a trailing edge 12 substantially parallel to the leading edge 11, and side edges 13, 14. The sheet also comprises a first face 15, and an opposite second face 16.

On at least the first face 15 of the sheet 10 there is disposed a pattern of non-tacky toner attracting and holding material, illustrated generally by reference numeral 17 in FIG. 1. The pattern 17 is spaced from the leading edge 11, as indicated by the reference numeral 18. Preferably this spacing 18 is at least about two inches, e.g. at least about three inches, but may depend upon the particular type of machine with which the cleaner sheet 10 is utilized.

The material forming the pattern 17 preferably is pressure sensitive cohesive material, such as commercially available from Toppan Corporation of Japan under the designation TN-124, and also as shown in U.S. Pat. Nos. 4,918,128, 5,427,851, and 5,201,464. The material forming the pattern 17 is typically applied to the face 15 using conventional coating equipment such as used in the manufacture of business forms having such cohesive thereon (as in U.S. Pat. Nos. 5,201,464). The thickness of application of the material forming the pattern 17 is not particularly critical, just so that it is thick enough so that it will effectively attract and hold undesired toner on machine components, but not so thick that the material is wasted. A typical thickness is about 8.5–11 microns.

Unlike conventional business forms having a pressure sensitive cohesive as the sealing material therefor (such as in U.S. Pat. Nos. 5,201,464), the material forming the pattern 17 according to the invention is applied in such a way that it covers a significant portion of the face 15, at least 15%, preferably at least about 20%, and for many situations most preferably at least about 30%. In the embodiment illustrated in FIG. 1 the material forming the pattern 17 covers about 33% of the face 15.

While the pattern 17 may take a wide variety of forms, one form that is particularly desirable is the plurality of elongated substantially linear strips 20 illustrated in FIG. 1. The strips are elongated in a dimension 21, which is substantially transverse to the leading edge 11 of the sheet 10, and also spaced from each other—as indicated at 22—a substantially uniform distance also transverse to the leading edge 11. Where no cohesive strip 20 is provided the surface of the face 15 is exposed. In the embodiment actually illustrated in FIG. 1, the sheet is an 8½×14 inch sheet, with the strips 20 each having a width (parallel to the leading edge 11) of about 0.5 inches, the spacing 22 (which is also the same spacing from the side edges 13, 14 and the nearest strip 20) is about ⅜ of an inch.

The sheet 10 also preferably has indicia associated therewith. For example the word indicia 24 and the arrows 25 may indicate the feed direction for the sheet 10 (that is designating the edge 11 as the leading edge). Various other printed indicia may be provided, which provides instructions to the user. For example the indicia 26 may instruct the user to feed the sheet 10 face up (with the first face 10 facing upwardly) to clean the top rollers of a piece of equipment, while the indicia 27 may instruct the user to feed the sheet 10 face down to clean the bottom rollers, and the indicia 28 may instruct the user to tape two of the sheets 15 back to back to clean both top and bottom rollers. The indicia 29 and 30 may give special instructions for particular types of equipment with which the sheet 10 is to be used. For example the indicia 29 may instruct for Moore model PS-3 SpeediSealer® pressure seal machines, to use the manual forms advance wheel to feed the cleaning sheet 10, while the indicia 30 instructs for Moore models PS-4 and PS-5 machines to use exit divert or jog forward buttons to feed the cleaning sheet 10.

Figure 2:
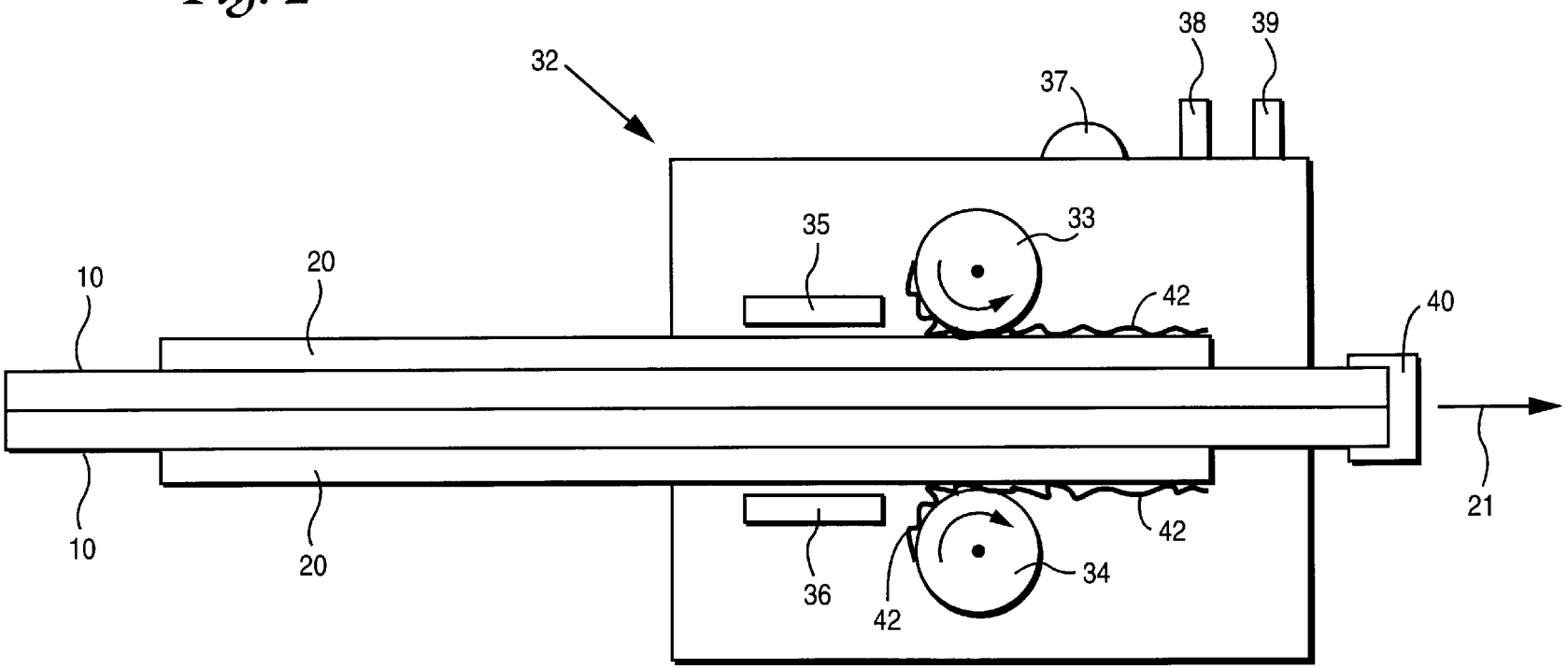
FIG. 2 is a side schematic view showing a composite sheet, such as seen in FIG. 1, being fed through a document or business forms handling machine to practice the method of the invention.

FIG. 2 schematically illustrates the use of a sheet 10, with another sheet 10 back to back (that is with the cohesive strips 20 of each facing opposite from each other) to effect cleaning of a document or business forms handling machine shown schematically at 32. The machine 32 typically includes one or more top rollers 33, one or more bottom rollers 34, and document or form guiding surfaces 35, 36. It is to be understood that the components illustrated for the machine 32 are all illustrated very schematically, and a wide variety of different types of the number of rollers 33, 34, or surfaces 35, 36 may be provided in any particular machine. While a wide variety of machines 32 may be utilized, which somehow have toner associated therewith, the most desirable machines for the use of the sheets 10 according to the invention comprise photocopiers, laser printers, and pressure seal machines (such as the Moore SpeediSealer® machines).

The machine 32 is shown, schematically, with a manual forms advance wheel 37, an exit divert button 38, and a jog forward button 39. Not all machines will include all of the elements 37–39 but may include one or more thereof, or may include other features that are equivalent thereto; or the sheets 10 may be used simply in association with normal feed through mechanism for the machine 32.

In FIG. 2, the sheets 10 are attached back to back with a piece of tape 40 (although of any suitable other mechanism for that purpose may be provided). The sheets 10 are fed in the direction 21 through the machine 32—such as by using the wheel 37 or the buttons 38, 39, so that the cohesive strips 20 come in contact with the rollers 33, 34 and/or the guide surfaces 35, 36. Toner which has accumulated on the elements 33–36 is attracted by the cohesive strips 20 and therefore removed from the elements 33–36 and held by the cohesive 20 and the paper forming the sheet 10. Removed toner is shown schematically at 42 in FIG. 2. The entire feed through procedure takes less than a minute, involves no solvents or like chemicals, and may be performed by the average operator for the machine 32 rather than requiring involvement of a service technician or engineer. The procedure using the sheets 10, which feed through the machine 32 completely in the direction 21, is thus effective to remove the majority of the unwanted toner (42) which has collected on the elements 33–36 so that the documents or business forms being handled thereby will not be streaked or otherwise adversely impacted.

Figure 3:
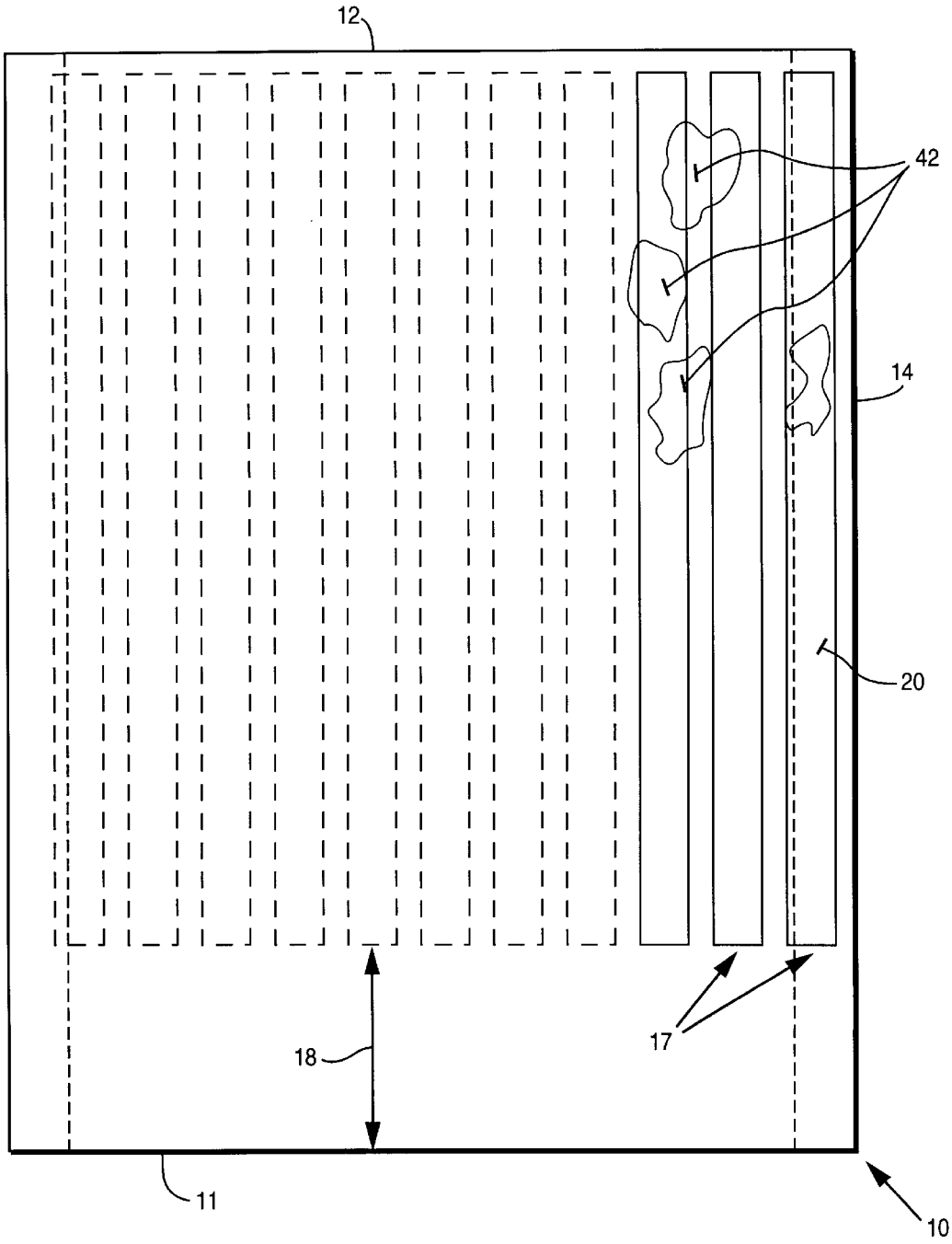
FIG. 3 is a top plan view of another form of an exemplary sheet according to the invention after it has passed through a document or business forms handling machine and has cleaned the machine by removing the undesired toner build-up therefrom.

FIG. 3 provides a schematic illustration of the use of a slightly modified version of the form 10 according to the present invention (essentially the same as the form 10 illustrated in FIG. 1 only an 8½×11 inch sheet with a much smaller spacing 18 from the leading edge 11) which shows the used toner 42 which has been removed from the machine 32 by a single passage of the sheet 10 in the direction 21 through the machine 32. Once the sheet 10 has been used as illustrated in FIG. 3 it is simply discarded in the normal trash, no special handling techniques being necessary.

Figure 4:
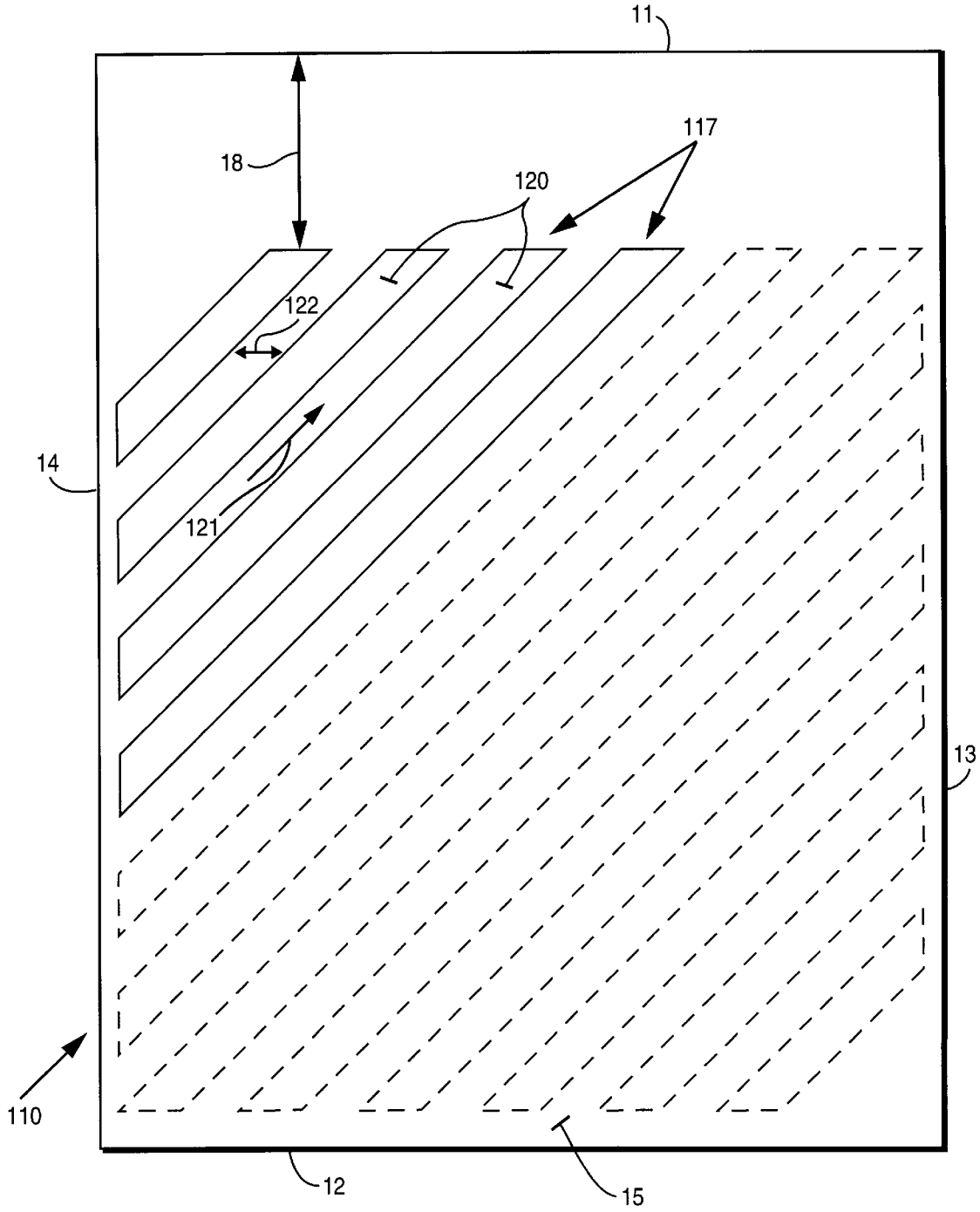
FIGS. 4 and 5 are top plan views of embodiments of cleaner sheets according to the invention that are alternatives to that illustrated in FIG. 1.
Figure 5:
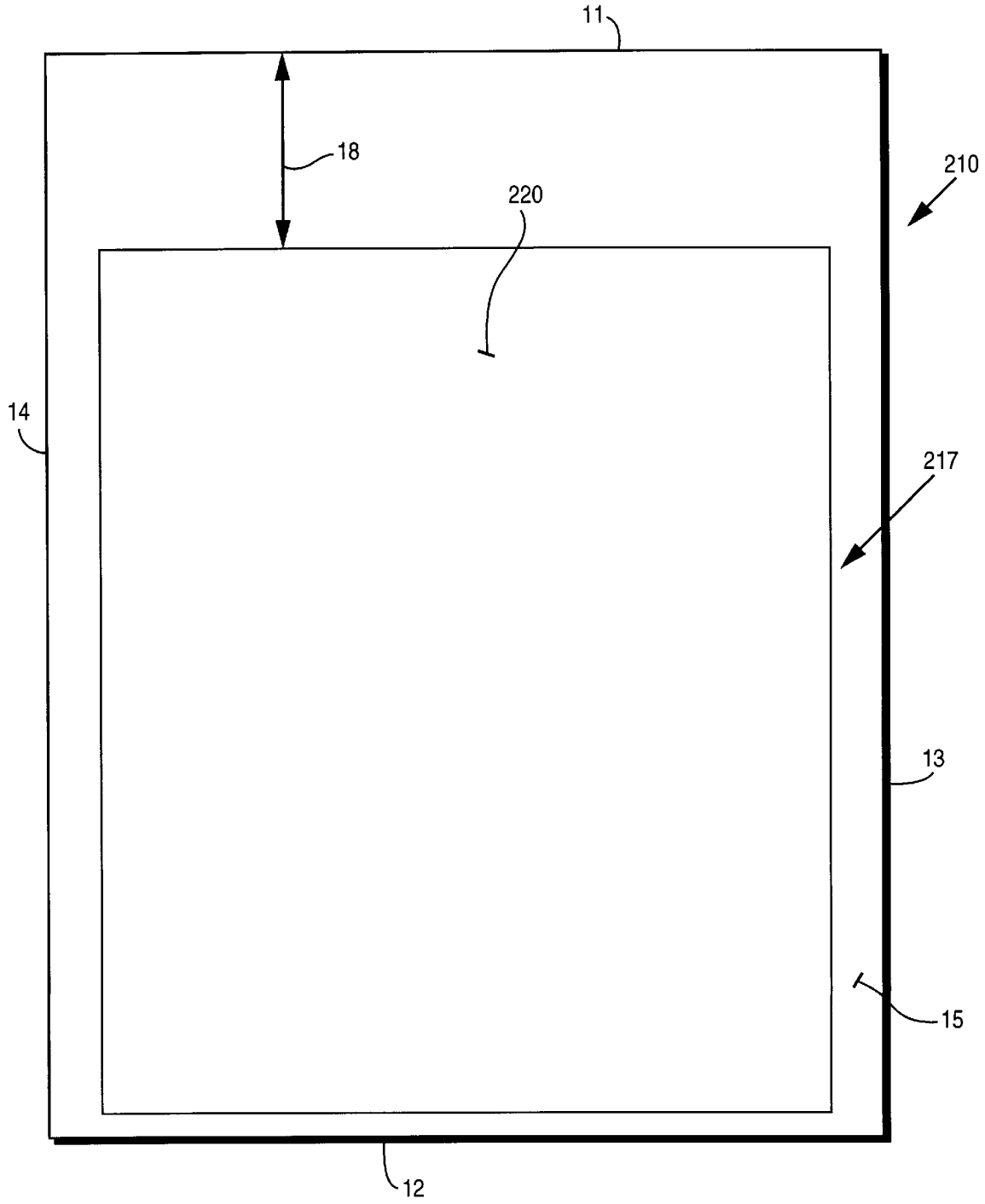

There is a wide variety that the patterns of the toner attracting and holding material may take—such as the pattern 17 illustrated in FIGS. 1 and 3. For example as illustrated in FIG. 4, for a sheet 110 according to the invention a diagonal pattern is provided. In FIG. 4 all of the components that are the same as those in the FIG. 1 embodiment are shown by the same reference numeral, while those which are slightly different are shown by the same reference numeral proceeded by a "1". In this embodiment the pattern 117 includes a plurality of cohesive strips 120 which are elongated in the dimension 121 which makes an angle (e.g. of about 45°) with the leading edge 11, and the strips 120 spaced in a dimension 122 parallel to the leading edge 11. In the FIG. 5 embodiment, again where components identical to those in FIG. 1 are shown by the same reference numeral and those slightly modified are shown by the same reference numeral preceded by the numeral "2", the sheet 210 has a pattern 217 of cohesive in the form of a solid block 220 with the edges of the block 220 spaced from the edges 11–14 of the sheet 210. A wide variety of other patterns may also be provided as long as they are capable of performing the toner removing function desired, and as long as they do not require particular difficulty or expense in applying the cohesive material 20, 120, 220, or the like to the paper sheets 10, 110, 210. Also, especially where the weight and thickness of the sheets 10, 110, 210 is sufficient (such as about 100 lb. tag stock), the patterns 17, 117, 217 can be applied to both the faces 15, 16, rather than requiring attachment of the sheets 10 back to back as illustrated in FIG. 2 if it is desired to clean both top and bottom elements 33–36 at the same time.

The method according to the invention may be practiced whenever the machine 32 is in need of cleaning, e.g. either on a periodic basis (for example once every two weeks, or once every 10,000 sheets or forms have been processed, etc.), or whenever an indication of toner build up can be noticed (such as streaks or background imaging on the documents or business forms being handled). While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of cleaning a document or business forms handling machine having toner associated therewith, and also having rollers or paper guiding surfaces on which toner may collect, using a sheet of paper having a pattern of non-tacky toner attracting and holding material, comprising pressure sensitive cohesive, on at least a first face thereof, comprising the steps of:

(a) when the machine is in need of cleaning, feeding the sheet of paper into the machine so that the non-tacky toner attracting and holding pressure sensitive cohesive comes into contact with toner on the rollers or paper guiding surfaces, removing toner from the rollers or paper guiding surfaces; and (b) removing the sheet of paper, having removed-toner held thereon, from the machine, and ultimately discarding the sheet.

2. A method as recited in claim 1 wherein the machine has both upper and lower rollers and paper guiding surfaces, and wherein step (a) is practiced by feeding a sheet of paper having cohesive patterns on both first and second opposite faces thereof, to attract and hold toner on both the upper and lower rollers and paper guiding surfaces.

3. A method as recited in claim 2 comprising the further step of (c), prior to step (a), forming the sheet by attaching together two sheets of paper having a cohesive pattern on only a first face thereof so that the cohesive patterns face away from each other.

4. A method as recited in claim 1 wherein the machine comprises a manual forms advance wheel, and wherein steps (a) and (b) are practiced, at least in part, by feeding the sheet through the machine using the manual forms advance wheel.

5. A method as recited in claim 1 wherein the machine includes one or more of an exit divert button and a jog forward button; and wherein steps (a) and (b) are practiced, at least in part, by operating at least one of the exit divert and jog forward buttons.

6. A method as recited in claim 1 wherein steps (a) and (b) are practiced using a sheet having strips of pressure sensitive cohesive elongated in a first dimension and spaced from each other in a second dimension substantially transverse to the first dimension; and wherein step (a) is practiced, at least in part, by feeding the sheet in a first direction parallel to the first dimension.

7. A method as recited in claim 1 wherein steps (a) and (b) are practiced using a sheet having a plurality of spaced diagonal strips of pressure sensitive cohesive.

8. A method as recited in claim 1 wherein steps (a) and (b) are practiced by using a pressure sealer, photocopy machine, or laser printer, as the machine through which the sheet is fed.

9. A method as recited in claim 1 wherein steps (a) and (b) are practiced using a sheet having a thickness and weight substantially comparable to 20–38 lb. bond paper, or 80–100 lb. tag stock.

10. A cleaner sheet comprising:

a substantially quadrate sheet of paper having a thickness and weight substantially comparable to 20–36 lb. bond paper, or 80–100 lb. tag stock, a leading edge, a trailing edge substantially parallel to said leading edge, and first and second faces; and a pattern of non-tacky toner attracting and holding material, comprising pressure sensitive cohesive, disposed on at least said first face, spaced from at least said first edge, and covering at least about fifteen percent of said first face.

11. A cleaner sheet as recited in claim 10 wherein said cohesive has a thickness of about 8.5–11 microns.

12. A cleaner sheet as recited in claim 11 wherein said pressure sensitive cohesive comprises a styrene-natural rubber copolymer.

13. A cleaner sheet as recited in claim 10 wherein said pressure sensitive cohesive comprises a styrene-natural rubber copolymer.

14. A cleaner sheet as recited in claim 10 wherein said cohesive is in the configuration of substantially linear strips of cohesive elongated in a first dimension and spaced from each other in a second dimension substantially transverse to said first dimension, and wherein said first dimension is substantially transverse to said leading edge.

15. A cleaner sheet as recited in claim 10 wherein said pattern is spaced from said leading edge a distance of at least about two inches, and wherein said cohesive covers at least about 30% of said first face.

16. A cleaner sheet as recited in claim 10 wherein said pattern of pressure sensitive cohesive comprises a plurality of diagonally extending spaced strips of pressure sensitive cohesive.

17. A cleaner sheet as recited in claim 10 wherein said sheet comprises a composite sheet, including first and second sheets each having a pattern of cohesive on a first face thereof, said sheets being attached together with said patterns of cohesive facing away from each other.

18. A cleaner sheet comprising:

a substantially quadrate sheet of paper having a thickness and weight substantially comparable to 20–36 lb. bond paper, or 80–100 lb. tag stock, a leading edge, a trailing edge substantially parallel to said leading edge, and first and second faces;

a pattern of non-tacky toner attracting and holding material, comprising pressure sensitive cohesive, disposed on at least said first face, spaced from at least said first edge, and covering at least about fifteen percent of said first face; and wherein said sheet comprises a composite sheet, including first and second sheets each having a pattern of cohesive on a first face thereof, said sheets being attached together with said patterns of cohesive facing away from each other.

19. A combination comprising:

a document or business forms handling machine having toner associated therewith, and also having rollers and paper guiding surfaces on which toner may collect; and a sheet of paper having a thickness and weight substantially comparable to 20–38 lb. bond paper, or 80–100 lb. tag stock, and having a pattern of pressure sensitive cohesive on at least a first face thereof and covering at least about twenty percent of said first face, said material in contact with at least one roller or paper guiding surface and removing toner therefrom.

20. A combination as recited in claim 19 wherein said machine is a photocopier, laser printer, or pressure sealer; and wherein said pressure sensitive cohesive comprises a styrene-natural rubber copolymer having a thickness of about 8.5–11 microns.

* * * * *